US010309382B2

(12) United States Patent
Teraya et al.

(10) Patent No.: US 10,309,382 B2
(45) Date of Patent: Jun. 4, 2019

(54) VARIABLE DISPLACEMENT SWASH PLATE COMPRESSOR

(71) Applicant: Valeo Japan Co., Ltd., Saitama (JP)

(72) Inventors: Takanori Teraya, Saitama (JP); Katsumi Sakamoto, Saitama (JP); Kazuto Watanabe, Saitama (JP); Masayuki Kono, Saitama (JP)

(73) Assignee: Valeo Japan Co., Ltd., Saitama (JP)

( * ) Notice: Subject to any disclaimer, the term of this patent is extended or adjusted under 35 U.S.C. 154(b) by 146 days.

(21) Appl. No.: 15/322,302

(22) PCT Filed: Jun. 26, 2015

(86) PCT No.: PCT/JP2015/068456
§ 371 (c)(1),
(2) Date: Dec. 27, 2016

(87) PCT Pub. No.: WO2015/199207
PCT Pub. Date: Dec. 30, 2015

(65) Prior Publication Data

US 2017/0122300 A1 May 4, 2017

(30) Foreign Application Priority Data

Jun. 27, 2014 (JP) ..... 2014-133192

(51) Int. Cl.
*F04B 27/18* (2006.01)
*F04B 27/10* (2006.01)
(Continued)

(52) U.S. Cl.
CPC ..... *F04B 27/1804* (2013.01); *F04B 27/109* (2013.01); *F04B 27/1045* (2013.01);
(Continued)

(58) Field of Classification Search
CPC ..... F04B 2027/1804; F04B 2027/1809; F04B 2027/1813; F04B 2027/1818;
(Continued)

(56) References Cited

U.S. PATENT DOCUMENTS

2003/0086791 A1 5/2003 Breindel et al.
2005/0147503 A1* 7/2005 Kurita ..... F04B 27/1072 417/222.1

FOREIGN PATENT DOCUMENTS

EP 2088318 * 8/2009
JP 2002-031043 A 1/2002
(Continued)

OTHER PUBLICATIONS

International Search Report issued in PCT/JP2015/068456, dated Oct. 6, 2015 (2 pages).
(Continued)

*Primary Examiner* — Kenneth J Hansen
(74) *Attorney, Agent, or Firm* — Osha Liang LLP

(57) ABSTRACT

A piston compressor may prevent excessive oil from accumulating in a crank chamber while securing the supply of oil to a swash plate. In a piston compressor in which an oil separation passage is formed in a shaft and a crank chamber communicates with a suction chamber through the oil separation passage, a supply passage opens at a region of a cylinder block opposed to a swash plate to allow a working fluid introduced from a discharge chamber into the crank chamber to be supplied to the swash plate and a bypass passage allowing the crank chamber to constantly communicate with the suction chamber is provided to prevent the accumulation of excessive oil in the crank chamber regardless of the operation condition. The bypass passage com-
(Continued)

municates with the crank chamber at a region positioned in the outer side of a rotation trajectory of the swash plate in the radial direction.

16 Claims, 7 Drawing Sheets

(51) Int. Cl.
*F04B 39/00* (2006.01)
*F04B 39/02* (2006.01)

(52) U.S. Cl.
CPC ..... *F04B 27/1081* (2013.01); *F04B 39/0094* (2013.01); *F04B 39/0207* (2013.01); *F04B 2027/1813* (2013.01); *F04B 2027/1827* (2013.01); *F04B 2027/1836* (2013.01)

(58) Field of Classification Search
CPC ..... F04B 2027/1827; F04B 2027/1831; F04B 2027/1845; F04B 2027/185; F04B 39/0246; F04B 27/1804
See application file for complete search history.

(56) References Cited

FOREIGN PATENT DOCUMENTS

| | | | |
|---|---|---|---|
| JP | 2003-097423 | A | 4/2003 |
| JP | 2003-343440 | A | 12/2003 |
| JP | 2006-138231 | A | 6/2006 |
| JP | 2007-162561 | A | 6/2007 |
| JP | 2009-209739 | A | 9/2009 |

OTHER PUBLICATIONS

Written Opinion of the International Searching Authority issued in PCT/JP2015/068456, dated Oct. 6, 2015 (5 pages).

* cited by examiner

Example 1

Example 2

Example 3

VARIABLE DISPLACEMENT SWASH PLATE COMPRESSOR

TECHNICAL FIELD

The present invention relates to a variable displacement swash plate compressor having a structure of suitably adjusting oil inside a crank chamber defined by a cylinder block and a housing assembled to the cylinder block.

BACKGROUND ART

The compressor of this kind includes a cylinder block in which plural cylinder bores are formed, a front housing assembled to the front side of the cylinder block to define a crank chamber, and a rear housing attached to the rear side of the cylinder block via a valve plate, in which a suction chamber and a discharge chamber are formed, in which pistons are arranged in respective cylinder bores of the cylinder block so as to reciprocate, a shaft is supported by the front housing and the cylinder block so as to rotate freely, a swash plate rotating integrally with the shaft so that a tilt angle with respect to the shaft is variable is provided in the shaft, and engaging portions of the pistons are engaged with a peripheral edge portion of the swash plate through shoes, thereby converting a rotary motion of the swash plate into a reciprocating motion of the pistons through the shoes.

Moreover, a supply passage for allowing the discharge chamber to communicate with the crank chamber and an release passage for allowing the crank chamber to communicate with the suction chamber are provided. The pressure inside the crank chamber is controlled by arranging a control valve in the supply passage and adjusting the amount of working fluid flowing from the discharge chamber to the crank chamber by the control value for example, thereby changing the tilt angle of the swash plate with respect to the shaft and controlling the discharge amount. As oil is mixed in a working fluid flowing through the supply passage, the oil is supplied to the crank chamber by supplying the working fluid to the crank chamber.

In this case, as fluids entering the crank chamber, there are a supply gas supplied from the discharge chamber and a blowby gas entering from clearances between the cylinder bores and the pistons. As a fluid going out from the crank chamber, there is an release gas going out into the suction chamber formed in the rear housing through the release passage. Therefore, the oil amount (amount of lubricating oil) inside the crank chamber may vary by the flow of these fluids according to operation conditions.

Incidentally, when the oil amount inside the crank chamber is too small, there is a danger of seizure occurring in a sliding portion such as the swash plate due to lubrication shortage. Accordingly, a device for giving a function of separating oil to the inside of the crank chamber and so on have been considered in the past for preventing the oil from being taken out from the crank chamber (for allowing the oil to be held in the crank chamber).

For example, in a piston compressor disclosed in Patent Literature 1 below, an release hole forming part of an release passage for releasing the working fluid flowing into the crank chamber to the suction chamber is formed in a shaft, and the release hole formed in the shaft is configured by an axial direction passage provided along a shaft center from a rear end of the shaft toward a front end side and a radial direction passage communicating with the axial direction passage and opening to the crank chamber to form an entrance portion of the release passage, thereby separating oil from the working fluid flowing from the radial direction passage by using a centrifugal force generated by rotation of the shaft.

CITATION LIST

Patent Literature

Patent Literature 1: JP-A-2003-343440
Patent Literature 2: JP-A-2006-138231

SUMMARY OF INVENTION

Technical Problem

However, in the variable displacement swash plate compressor having the structure in which part of the release passage which introduces the working fluid from the crank chamber to the suction chamber is formed in the shaft to separate oil by using centrifugal force generated by rotation of the shaft, the function of separating oil is increased as the rotation speed is increased, therefore, oil tends to accumulate in the crank chamber. When oil excessively accumulates in the crank chamber, viscous oil is stirred by the swash plate, which causes a problem that temperature in the crank chamber is increased due to heat generated by shear friction between the swash plate and the oil.

In response to the above problem, another structure has been also considered in the past, in which a bypass passage is provided in a cylinder bore gap part of the cylinder block to allow the crank chamber to communicate with the suction chamber, and the bypass passage can be continuously opened to the crank chamber only in an off-operation (when a piston stroke is the minimum) to recirculate the oil excessively accumulating in the crank chamber to the suction chamber by utilizing the pressure difference between the crank chamber and the suction chamber (refer to Patent Literature 2).

However, the variable displacement type compressor mounted on a vehicle is controlled so that the discharge amount (cooling capacity) is reduced by reducing the piston stroke at the time of high rotation where the load of the engine is increased, and so that the discharge amount (cooling capacity) is increased by increasing the piston stroke at the time of low rotation such as at the time of idle operation.

Accordingly, in the compressor provided with the bypass passage disclosed in the above Patent Literature 2, the bypass passage is blocked by the piston and does not communicate with the crank chamber constantly at the time of low rotation where the piston stroke is increased, therefore, accumulated oil is not capable of being discharged efficiently. Therefore, there is the problem that the oil in the crank chamber is stirred by the swash plate and the temperature in the crank chamber is increased.

The present invention has been made in view of the above circumstances, and a main object thereof is to provide a variable displacement swash plate compressor capable of preventing excess oil from accumulating in the crank chamber in any operation state while securing oil supply to the swash plate.

Solution to Problem

According to an embodiment of the present invention, there is provided a variable displacement swash plate compressor including a cylinder block in which plural cylinder bores are formed, a front housing assembled to the front side of the cylinder block to define a crank chamber, a rear housing attached to the rear side of the cylinder block, in which a suction chamber and a discharge chamber are formed, pistons arranged in respective cylinder bores of the cylinder block so as to reciprocate, a shaft supported by the front housing and the cylinder block so as to rotate freely, a swash plate rotating integrally with the shaft and attached to the shaft so that a tilt angle is variable, and shoes interposed between a peripheral edge portion of the swash plate and the pistons so as to slide, converting a rotary motion of the swash plate into a reciprocating motion of the pistons, in which a supply passage allowing the discharge chamber to communicate with the crank chamber and an release passage allowing the crank chamber to communicate with the suction chamber are provided for controlling a pressure in the crank chamber to control the tilt angle of the swash plate with respect to the shaft, part of the release passage is formed by an oil separation passage formed in the shaft, and the oil separation passage is configured by including a shaft hole extended in an axial direction from a rear end to a front end of the shaft and a side hole extended in a radial direction and communicating with the shaft hole as well as opening to the crank chamber, and in which the supply passage is configured by including a through hole formed in the cylinder block so that the through hole opens at a region opposed to the swash plate, and a bypass passage allowing the crank chamber to constantly communicate with the suction chamber is provided separately from the release passage.

Accordingly, the end potion of the supply passage facing the crank chamber (through hole formed in the cylinder block forming part of the supply passage) opens at the region of the cylinder block opposed to the swash plate, therefore, the working fluid containing oil supplied from the discharge chamber to the crank chamber through a supply passage is directly supplied to the swash plate. Accordingly, a plentiful of oil can be secured with respect to the swash plate.

Incidentally, the oil separation passage forming part of the release passage is formed in the shaft, and oil is separated from the working fluid flowing from the side hole by a centrifugal force generated by rotation of the shaft, therefore, it is possible to reduce oil flowing out from the crank chamber to the suction chamber. However, the centrifugal separation function of oil by the oil separation passage is increased at the time of high rotation of the shaft, excessive oil tends to accumulate in the crank chamber. Nevertheless, the crank chamber constantly communicates with the suction chamber also by the bypass passage, therefore, oil in the crank chamber is discharged by the pressure difference between the crank chamber and the suction chamber, which can prevent the accumulation of excessive oil in the crank chamber.

As the crank chamber constantly communicates with the suction chamber through the bypass passage, oil in the crank chamber can be discharged through the bypass passage regardless of the size of a piston stroke, which can prevent accumulation of excessive oil in the crank chamber. Accordingly, excessive oil in the crank chamber does not accumulate in any operation state, and the oil is not stirred by the swash plate, which can prevent the temperature rise of the crank chamber.

Here, it is preferable that a region of the bypass passage communicating with the crank chamber (region of the communication path in the cylinder block which communicates with the crank chamber) is positioned in an outer side of a rotation trajectory of the swash plate in the radial direction.

The oil supplied through the supply passage is sprayed on the swash plate, then, flicked off to the outer side in the radial direction by rotation of the swash plate and reaching the outer side of the rotation trajectory of the swash plate. However, since such oil is one which has been used for lubrication of the swash plate, it does not inhibit the lubrication of the swash plate even when the oil is let be discharged. If the bypass passage (communication path) were configured to communicate with the crank chamber in the inner side of the outer edge of the rotation trajectory of the swash plate in the radial direction, oil sprayed on the swash plate through the supply passage would be sucked by the bypass passage and is discharged to the suction chamber before or while being used for the lubrication of the swash plate, which may impair the lubrication of the swash plate. Accordingly, the bypass passage is configured to communicate in the outer side of the rotation trajectory of the swash plate in the radial direction, thereby securing sufficient lubrication of the swash plate and discharging oil not contributing to the lubrication of the swash plate to prevent excessive oil from accumulating in the crank chamber.

It is also preferable that the release passage allows the oil separation passage to communicate with the suction chamber through an orifice hole formed in the valve plate provided between the cylinder block and the rear housing, and that the bypass passage allows the communication path to communicate with the suction chamber through another orifice hole formed in the valve plate.

As the flow of the released gas introduced to the suction chamber through the oil separation passage and the flow of the oil introduced to the suction chamber through the bypass passage are independent from each other, it is possible to prevent a concern that one flow is inhibited by the other flow as well as it is possible to adjust the amount of release gas or the discharge amount of oil to the proper amount independently by adjusting sizes of respective orifice holes.

The bypass passage (communication path of the cylinder block) may communicate with the crank chamber by using part or all of a bolt hole formed in the cylinder block for inserting a bolt which fastens the cylinder block to the housings in the axial direction.

According to the above structure, it is not necessary to change design of the position of the bolt hole and so on for forming an entrance of the bypass passage. Moreover, the entrance of the bypass passage is formed in a peripheral edge of an opening end of the bolt hole (formed by a gap between the bolt and the inner peripheral surface of the bolt hole), thus suppressing turbulence of the working fluid stirred in the crank chamber and allowing the oil to be released to the suction chamber stably.

As an embodiment in which part of the bolt hole is used, the bypass passage may be configured by including the bolt hole and the communication path opening at the inner peripheral surface of the bolt hole. As an embodiment in which whole of the bolt hole is used, the bypass passage may be configured by including the bolt hole and a groove formed from an end of the bolt hole to an end surface of the cylinder block.

It is also preferable that the bypass passage includes a first passage forming portion drilled obliquely upward from a lower part of the cylinder block on the crank chamber side through between the cylinder bores, and a second passage forming portion drilled in approximately parallel to the shaft from an end surface of the cylinder block on the opposite side of the end surface opposed to the crank chamber and communicating with the first passage forming portion.

According to the above structure, the region of the bypass passage (communication path) communicating with the crank chamber side can be positioned in the outer side of the rotation trajectory of the swash plate in the radial direction, and the region opposed to the valve plate (region communicating with the suction chamber side) can be formed in an arbitrary position in the radial direction.

The oil inside the crank chamber becomes a misty state by being flicked off by the swash plate, however, the density of oil is higher in the vicinity of the lower part of the crank chamber due to the effect of gravity. In order to discharge the oil in the crank chamber effectively, it is desirable that the bypass passage is configured to communicate with the lower part of the crank chamber.

For example, when a position under the center of a hole which supports the shaft is prescribed as 0 (zero) degree, an opening end of the bypass passage with respect to the crank chamber may be formed in a range of 0°±10° as well as may be formed in a range of 45°±10°.

Advantageous Effects of Invention

As described above, in the variable displacement swash plate compressor in which the oil separation passage is formed in the shaft and the crank chamber communicates with the suction chamber through the oil separation passage, the supply passage opens at the region of the cylinder block opposed to the swash plate to allow the working fluid containing oil introduced from the discharge chamber to the crank chamber to be supplied to the swash plate, and the bypass passage allowing the crank chamber to constantly communicate with the suction chamber is provided to thereby discharge the oil inside the crank chamber, therefore, it is possible to prevent the accumulation of excessive oil in the crank chamber regardless of operation state while securing lubrication with respect to the swash plate and to prevent the temperature rise of the crank chamber by the stirring of the oil.

DESCRIPTION OF EMBODIMENTS

Hereinafter, a best mode for carrying out the present invention will be explained with reference to the attached drawings.

Figure 1:
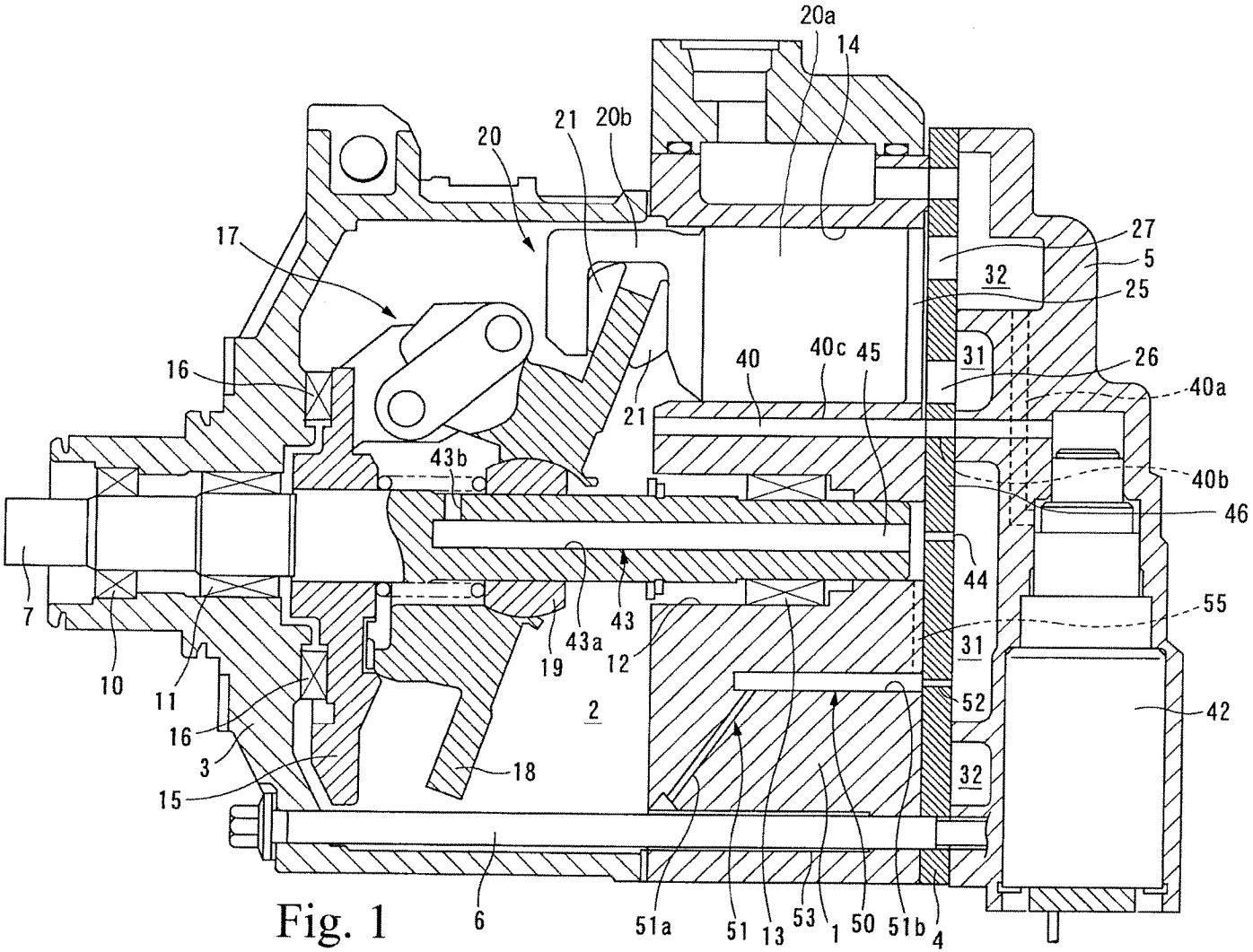
FIG. 1 is a cross-sectional view showing a configuration example of a compressor according to the present invention.

In FIG. 1, a compressor is configured by including a cylinder block 1, a front housing 3 assembled so as to cover the front side of the cylinder block 1 to define a crank chamber 2 between the cylinder block 1 and the front housing 3, and a rear housing 5 assembled to the rear side of the cylinder block 1 via a valve plate 4. The front housing 3, the cylinder block 1, the valve plate 4 and the rear housing 5 are fastened in the axial direction by fastening bolts 6.

In the crank chamber 2 defined by the front housing 3 and the cylinder block 1, a shaft 7 whose front end protrudes from the front housing 3 is housed. A not-shown drive pulley is provided on a portion of the shaft 7 protruding from the front housing 3, and the rotating power given to the drive pulley is transmitted to the shaft 7 through a clutch disc.

A front end side of the shaft 7 is sealed with respect to the front housing 3 with good airtightness by way of a sealing member 10 provided between the shaft 7 and the front housing 3, which is supported so as to rotate freely by a radial bearing 11. A rear end side of the shaft 7 is supported so as to rotate freely via a radial bearing 13 accommodated in an accommodation hole 12 formed in approximately the center of the cylinder block 1. Here, the radial bearings 11, 13 may be rolling bearings as well as plane bearings.

Figure 2A:
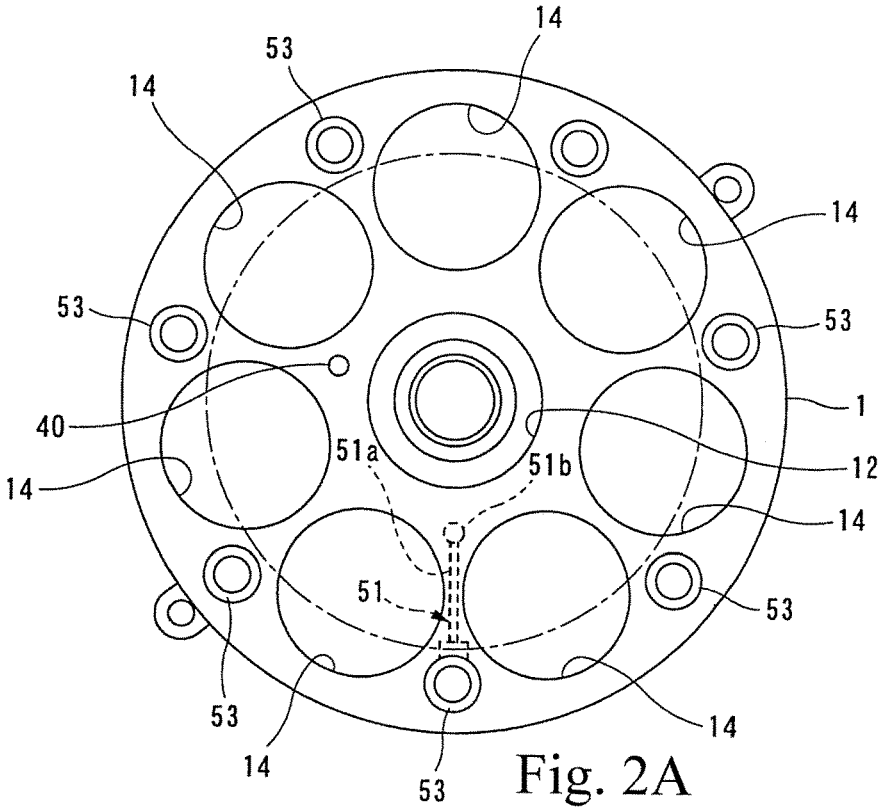
FIG. 2(*a*) is a view showing an end surface of the cylinder block which faces a crank chamber, and FIG. 2(*b*) is a view showing an end surface of the cylinder block which faces a valve plate.
Figure 2B:
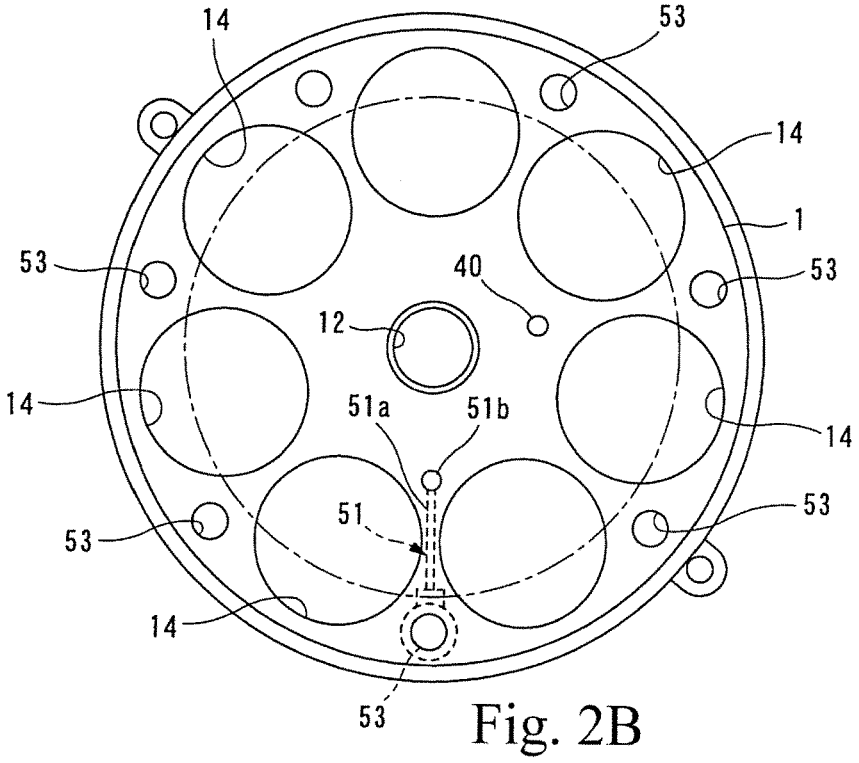

In the cylinder block 1, the accommodation hole 12 in which the radial bearing 13 and so on are accommodated and plural cylinder bores arranged at equal intervals on a circumference around the accommodation hole 12 are formed as shown in FIG. 2, and pistons 20 are inserted into the respective cylinder bores 14 so as to slidably reciprocate.

A thrust flange 15 rotating integrally with the shaft 7 is fixed to the shaft 7 inside the crank chamber 2. The thrust flange 15 is supported so as to rotate freely on an inner wall surface of the front housing 3 formed approximately perpendicular to the shaft 7 via a thrust bearing 16. Moreover, a swash plate 18 is connected to the thrust flange 15 through a link member 17.

The swash plate 18 is held so as to be tilted through a hinge ball 19 provided on the shaft 7, which is integrally rotated in synchronization with rotation of the thrust flange 15. The thrust flange 15 and the swash plate 18 connected to the thrust flange 15 through the link mechanism 17 configure a power transmission mechanism rotating in synchronization with rotation of the shaft 7.

The piston 20 is formed by joining a head portion 20*a* to be inserted into the cylinder bore 14 to an engaging portion 20*b* protruding to the crank chamber 2 in the axial direction, in which the engaging portion 20*b* is engaged with a peripheral edge portion of the swash plate 18 through a pair of shoes 21.

Accordingly, when the shaft 7 rotates, the swash plate 18 rotates in accordance with the rotation, and the rotating motion of the swash plate 18 is converted into a reciprocating straight motion of the piston 20 through the shoes 21, which changes a capacity of a compression chamber 25 defined between the piston 20 and the valve plate 4 in the cylinder bore 14.

A suction chamber 31 and a discharge chamber 32 formed in the outside of the suction chamber 31 are formed in the rear housing 5. A suction hole 26 which allows the suction chamber 31 to communicate with the compression chamber 25 through a suction valve (not shown) and a discharge hole 27 which allows the discharge chamber 32 to communicate with the compression chamber 25 through a discharge valve (not shown) are formed in the valve plate 4.

Moreover, a supply passage 40 allowing the discharge chamber 32 to communicate with the crank chamber 2 is formed by through holes 40*a*, 40*b* and 40*c* formed in the rear housing 5, the valve plate 4 and the cylinder block 1, and a pressure control valve 42 is arranged midway on the supply passage 40 in the rear housing 5 in the configuration example. A valve mechanism (not shown) is provided inside the pressure control valve 42, and an opening of the valve mechanism is adjusted, thereby adjusting the flow rate of a refrigerant flowing from the discharge chamber 32 to the crank chamber 2 through the supply passage and controlling the pressure in the crank chamber 2.

The supply passage 40 configure an end portion facing the crank chamber 2 so as to open at an end surface of the cylinder block 1, preferably at a portion opposed to a slightly inner side of a sliding contact portion of the swash plate 18 which slides with the shoes 21, thereby supplying oil mixed in the refrigerant transferred from the discharge chamber 32 through the pressure control valve 42 to a sliding contact surface of the swash plate 18 with respect to the shoes 21.

Moreover, the shaft 7 is provided with a later-described oil separation passage 43, and an release passage 45 allowing the crank chamber 2 to communicate with the suction chamber 31 is formed by the oil separation passage 43, a space 46 between the rear end of the shaft 7 and the valve plate 4 and an orifice hole 44 formed in the valve plate 4.

The oil separation passage 43 formed in the shaft 7 is configured by a shaft hole 43*a* formed on the shaft center of the shaft 7 from the rear end toward the front end so as to reach the middle position and a side hole 43*b* communicating with the shaft hole 43*a* and formed in the radial direction of the shaft 7 to open to the crank chamber 2, having a function of separating oil from a working fluid flowing from the side hole 43*b* by a centrifugal force generated by the rotation of the shaft 7.

Further, a small amount of working fluid is allowed to flow from the crank chamber 2 to the space 46 between the rear end of the shaft 7 and the valve plate 4 via a portion between the accommodation hole 12 in which the radial bearing 13 is housed and the shaft 7 as well as working fluid flowing via the above described oil separation passage 43.

Furthermore, a bypass passage 50 allowing the crank chamber 2 to communicate with the suction chamber 31 is formed separately from the release passage 45 in the compressor. The bypass passage 50 is configured by including a communication path 51 formed in the cylinder block 1 and an orifice hole 52 formed in the valve plate 4 so as to communicate with the communication path 51.

The orifice hole 52 forming part of the bypass passage is set to have a smaller area (for example, 50 to 70%) in relation to the orifice hole 44 forming part of the release passage 45, thereby preventing the working fluid discharged to the suction chamber via the bypass passage from being excessive.

A region of the bypass passage 50 communicating with the crank chamber 2 (region where the communication path 51 formed in the cylinder block 1 communicates with the crank chamber 2) is positioned in the outer side of a rotation trajectory (represented by a dashed line in FIG. 2) of the swash plate 18 in the radial direction. In this example, the bypass passage 50 (communication path 51) opens at an inner peripheral wall near an opening end of a bolt hole 53 opening to the crank chamber 2, into which the fastening bolt 6 is inserted positioned in the lowest side.

The expression that "positioned in the outer side of the rotation trajectory in the radial direction" is a concept which includes not only positions strictly in the outer side of the rotation trajectory but also positions suitable for sucking oil which has been used for lubrication of the sliding contact portion of the swash plate.

The communication path 51 forming part of the bypass passage 50 is configured by a first passage forming portion 51*a* one end of which opens at the inner peripheral wall near the opening end of the bolt hole 53 and which is formed from that region toward the rear side so as to pass through between adjacent cylinder bores 14 as well as toward the central axis of the cylinder block (obliquely upward in this example), and a second passage forming portion 51*b* formed in approximately parallel to the shaft 7, one end of which is connected to the first passage forming portion 51*a* and the other end of which opens at a rear-side end surface of the cylinder block 1.

Figure 3A:
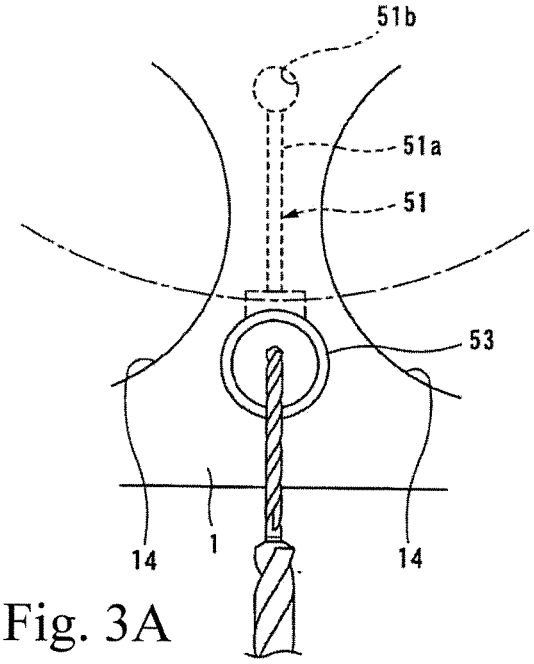
FIG. 3 are views showing a bypass passage and a forming method thereof, in which (a) is a view seen from an end surface of the cylinder block which faces the crank chamber and (b) is a sectional side view.
Figure 3B:
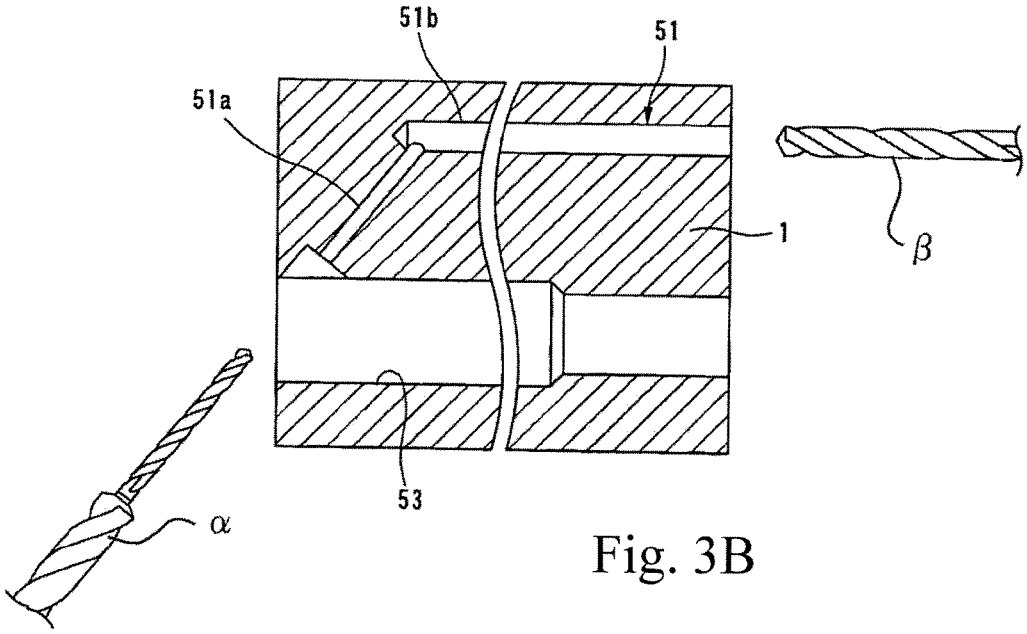

The bolt hole 53 is not formed to have a uniform diameter from the front side to the rear side. A clearance with respect to the fastening bolt 6 is smaller at a portion in the rear side, and the diameter is relatively increased from the portion toward to the front side, therefore, a clearance with respect to the fastening bolt 6 is larger also as shown in FIG. 3. The first passage forming portion 51*a* opens at the portion where an inner diameter of the bolt hole 53 opening to the crank chamber 2 is relatively large, which is formed by inserting a drill $\alpha$ from the opening end of the bolt hole 53 from the obliquely downward direction, and by drilling obliquely upward from the vicinity of the opening end of the bolt hole 53 through between adjacent cylinder bores. The second passage forming portion 51*b* is formed by being drilled in the axial direction of the housing hole 12 by a drill $\beta$ or by casting (die-cast) from the position on the end surface in the rear side aligned with the orifice hole 52 in the cylinder block 51.

The first passage forming portion 51*a* is formed to have a smaller diameter than the second passage forming portion 51*b*, and respective passage forming portions can be connected to each other even when variation in manufacture occurs.

In the above structure, when the shaft 7 rotates by the rotating power given to the drive pulley, the swash plate 18 is rotated, and the rotary motion of the swash plate 18 is converted into the reciprocating straight motion of the pistons 20 through the shoes 21, and the pistons 20 start to reciprocate inside the cylinder bores 14. The volume of the compression chamber 25 formed between the pistons 20 and the valve plate 4 inside the cylinder bores 14 is changed by the reciprocating motion of the pistons 20. During a suction stroke, the working fluid is sucked from the suction chamber 31 to the compression chamber 25 through the suction hole 26 opened and closed by the suction valve. During a compression stroke, the compressed working fluid is discharged from the compression chamber 25 to the discharge chamber 32 through the discharge hole 27 opened and closed by the discharge valve.

The discharge amount of the compressor is determined by the stroke of the piston 20, and the stroke is determined by a pressure difference between a pressure applied to a front surface of the piston 20, namely, a pressure of the compression chamber 25 and a pressure applied to a back surface of the piston 20, namely, a pressure inside the crank chamber 2. Specifically, when the pressure inside the crank chamber 2 is increased, the pressure difference between the compression chamber 25 and the crank chamber 2 is reduced, therefore, a tilt angle (swinging angle) of the swash plate 18 is reduced, as a result, the stroke of the piston 20 is reduced and the discharge capacity is reduced. Conversely, when the pressure inside the crank chamber 2 is reduced, the pressure difference between the compression chamber 25 and the crank chamber 2 is increased, therefore, the tilt angle (swinging angle) of the swash plate 18 is increased, as a result, the stroke of the piston 20 is increased and the discharge capacity is increased.

During a high rotation such as at the time of acceleration, an amount of refrigerant gas supplied from the discharge chamber 32 to the crank chamber 2 by the pressure control valve 42 through the supply passage 40 is increased and the pressure in the crank chamber is increased.

Accordingly, the swinging angle of the swash plate 18 is reduced (the piston stroke is reduced), and the discharge amount is reduced. In such case, the rotation of the shaft 7 is fast, therefore, the oil separating function by the oil separation passage 43 is increased and the oil tends to accumulate in the crank chamber 2. However, the bypass passage 50 constantly communicates with the crank chamber 2, therefore, the oil accumulating in the crank chamber 2 is discharged to the suction chamber 31 through the bypass passage 50 due to the pressure difference between the crank chamber 2 and the suction chamber 31, which prevents excessive oil from accumulating in the crank chamber 2.

As excessive oil is discharged from the crank chamber, oil enough to be scraped up by the swash plate 18 does not exist inside the crank chamber, however, the supply passage 40 opens at the region opposed to the swash plate in this structure, oil mixed in the refrigerant gas introduced through the supply passage 40 is directly supplied to the swash plate 18. Therefore, sufficient lubrication with respect to the swash plate can be secured regardless of the oil amount inside the crank chamber.

In this case, the oil supplied through the supply passage 40 is sprayed on the swash plate 18, then, flicked off to the outer side in the radial direction due to the rotation of the swash plate 18, after that, introduced in the lower direction due to the gravity, and discharged through the bypass passage 50. The oil discharged through the bypass passage 50 is the oil which has been used for lubrication of the swash plate 18 (oil not contributing to lubrication of the swash plate 18), therefore, there is no fear that lubrication of the swash plate 18 is impaired.

As described above, according to the structure, the supply passage 40 opens so as to be opposed to the swash plate 18 to thereby secure sufficient lubrication of the swash plate 18, and the bypass passage 50 is configured to communicate with the crank chamber 2 in the outer side of the rotation trajectory of the swash plate 18 in the radial direction to thereby discharge only the oil not contributing to the lubrication of the swash plate 18 and to thereby prevent excessive oil from accumulating in the crank chamber 2.

Also in the above structure, the bypass passage 50 opens at the inner peripheral surface of the bolt hole 53 provided at the lower part of the crank chamber 2, therefore, the oil accumulating in the crank chamber 2 can be effectively discharged. Moreover, the position of the existing bolt hole 53 is utilized for forming the bypass passage 50, therefore, it is not necessary to change design of the position of the bolt hole and so on for forming the bypass passage.

Furthermore, as an entrance of the bypass passage is an opening end of the bolt hole 53 into which the fastening bolt 6 is inserted (a gap between the fastening bolt 6 and the inner peripheral surface of the bolt hole 53), turbulence of the working fluid is suppressed at the time of flowing into the bypass passage even when the working fluid inside the crank chamber is stirred and turbulent, therefore, it is possible to allow the oil to be released to the suction chamber stably.

Additionally, as the orifice hole 44 of the release passage 45 and the orifice hole 52 of the bypass passage are separately provided in the above structure, the flow of the released gas introduced to the suction chamber 31 through the oil separation passage 43 (release passage 45) and the flow of the oil introduced to the suction chamber 31 through the bypass passage 50 can be independent from each other, therefore, there is no concern such that one flow is interrupted by the other flow. Accordingly, it is possible to independently adjust the amount of released gas or the discharge amount of oil so as to obtain desired characteristics by adjusting sizes of respective orifice holes.

Incidentally, in the above example, an example in which the bypass passage 50 (communication path 51) uses the bolt hole 53 positioned in the lowest part and the bolt hole 53 is in the lowest part of the crank chamber 2 (position in the lower part of the shaft in the vertical direction) has been illustrated, however, the position of the bypass passage 50 is not limited to the lowest part of the crank chamber 2 as long as the bypass passage 50 communicates with the crank chamber 2 in the outer side of the rotation trajectory of the swash plate 18 in the radial direction.

Figure 4A:
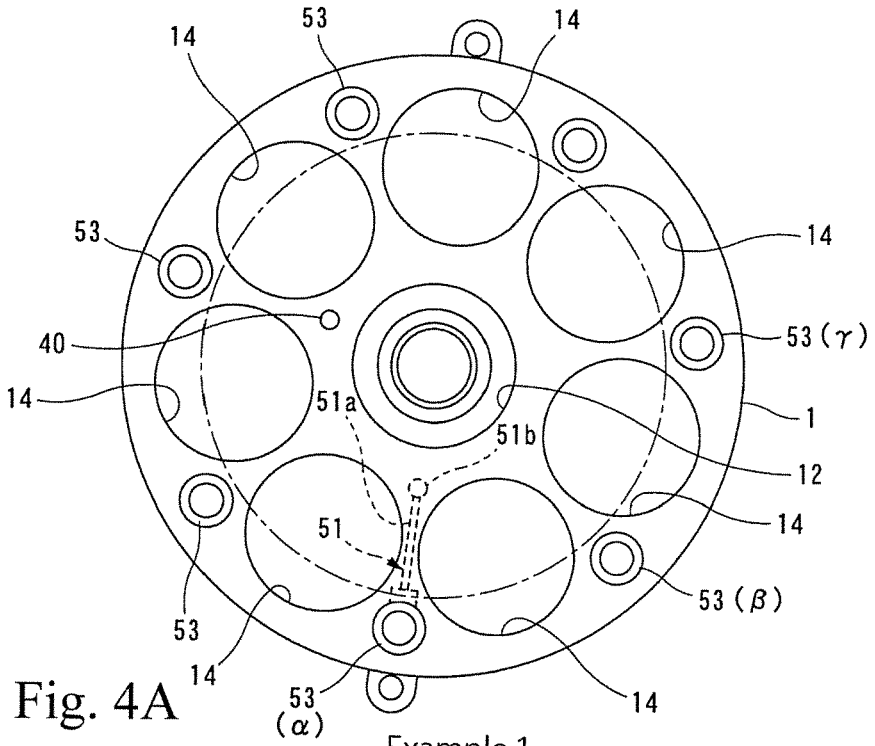
FIG. 4 show an example in which a position of a bolt hole is variant in the compressor according to the present invention, showing a case where the bypass passage is formed by using a bolt hole in the lowest part, in which FIG. 4(*a*) is a view showing an end surface of the cylinder block which faces the crank chamber and FIG. 4(*b*) is a view showing an end surface of the cylinder block which faces the valve plate.
Figure 4B:
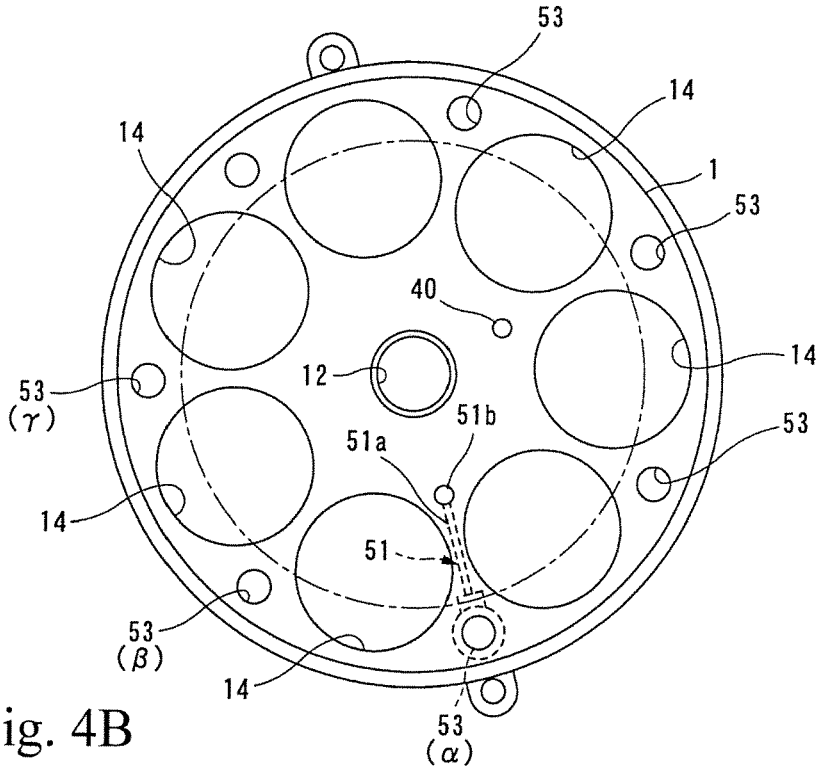

The bolt hole 53 is not always formed in the lowest part of the crank chamber 2 due to the circumstances of the compressor installation or its design. For example, assuming that a direction under the center of the housing hole 12 of the cylinder block 1 supporting the shaft 7 via the radial bearing 13 is prescribed as 0 (zero) degree, in the case where the bolt hole 53 in the lowest part is not formed under the shaft 7 (housing hole 12) and is formed within a range of 0°±10° with respect to the center of the housing hole 12, the adjacent bolt hole β is formed within a range of 45°±10° with respect to the center of the housing hole 12 and a further adjacent bolt hole γ is formed in a range of 90°±10° with respect to the center of the housing hole 12 as shown in FIG. 4, the bypass passage 50 may be formed by utilizing any of the above bolt holes 53 from the perspective of preventing the accumulation of excessive oil in the crank chamber 2 in any operation state while securing the supply of oil to the swash plate 18.

Figure 5:
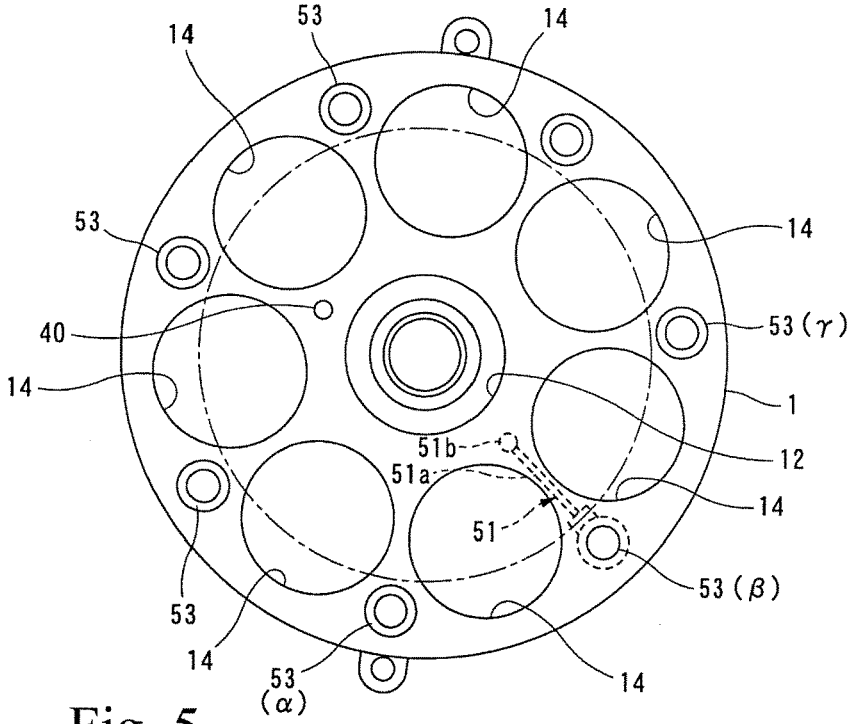
FIG. 5 shows a case where the bypass passage is formed by using a bolt hole adjacent to the bolt hole in the lowest part in the compressor having the arrangement of the bolt holes shown in FIG. 4, which is a view showing the end surface of the cylinder block which faces the crank chamber.
Figure 6:
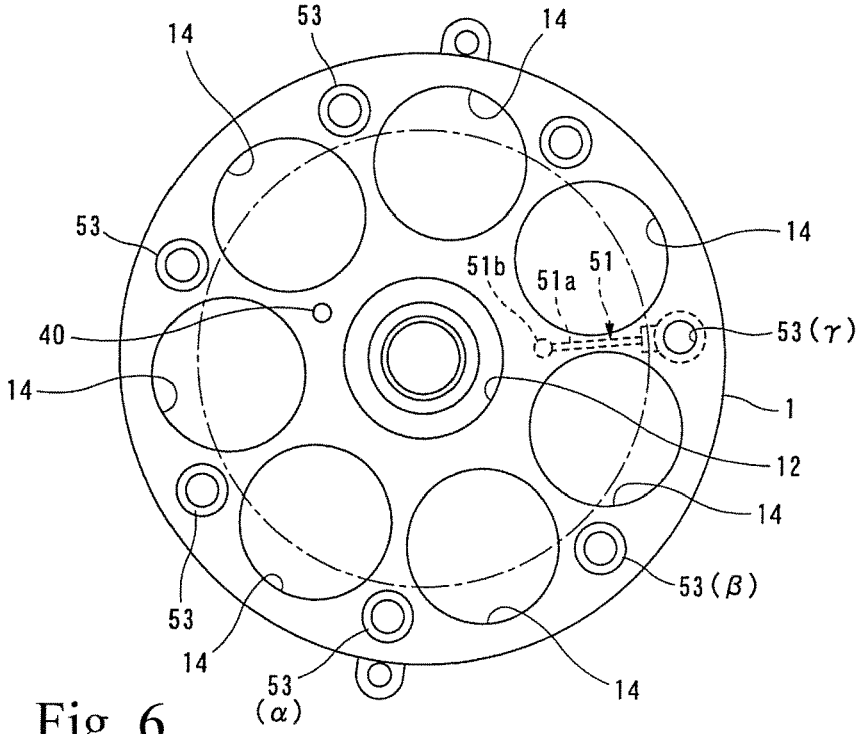
FIG. 6 shows a case where the bypass passage is formed by using a bolt hole which is two holes adjacent to the bolt hole in the lowest part in the compressor having the arrangement of the bolt holes shown in FIG. 4, which is a view showing the end surface of the cylinder block which faces the crank chamber.
Figure 7A:
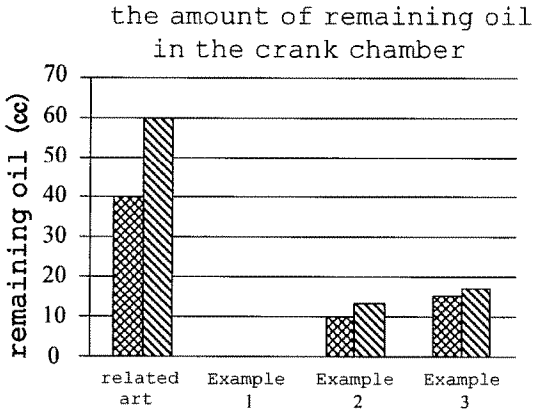
FIG. 7 show results obtained by performing endurance tests in high-speed operations (in a high-speed high-load operation and a high-speed low-load operation) and liquid start-up tests, in which (a) is a graph of comparison between the related art and Examples 1 to 3 concerning the amount of remaining oil in the crank chamber, (b) is a graph of comparison between the related art and Examples 1 to 3 concerning the oil circulation ratio (OCR) in a refrigeration cycle, (c) is a graph of comparison between the related art and Examples 1 to 3 concerning the crank temperature during endurance tests and (d) is a graph of comparison between the related art and Examples 1 to 3 concerning the start-up time of the compressor in liquid start-up tests.
Figure 7B:
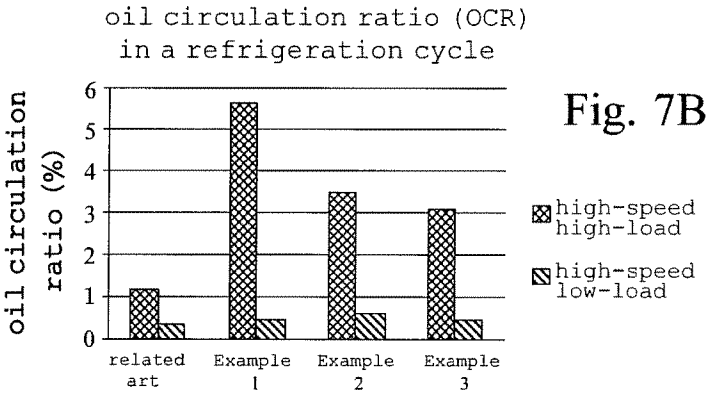
Figure 7C:
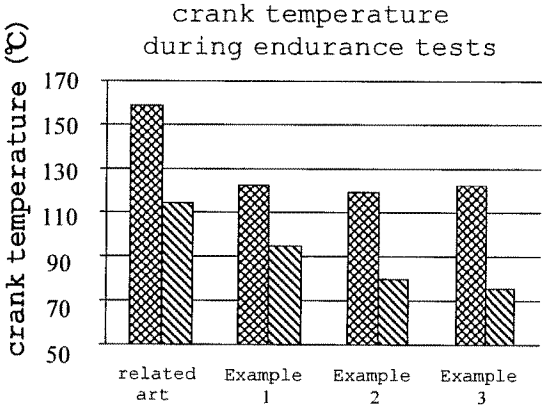
Figure 7D:
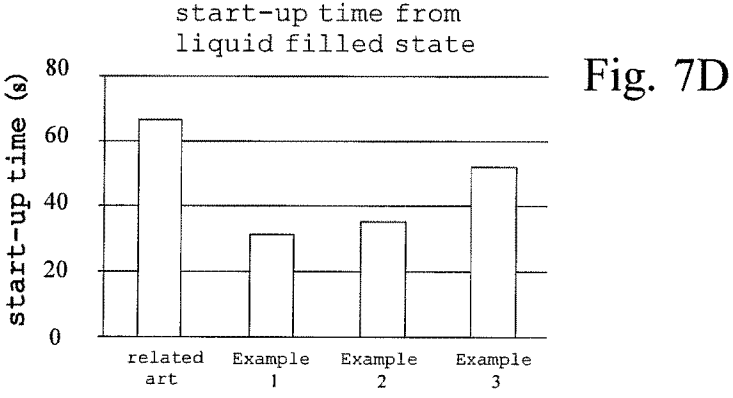

In order to compare examples with the existing structure (related-art example) not provided with the bypass passage, the following endurance tests and liquid start-up tests were performed and the results were evaluated. In order to confirm that any of the above bolt holes can be available, an example in which the communication path 51 forming the bypass passage 50 opens at an inner peripheral surface of the bolt hole α in the lowest part (position of 0°±10°) in the structure shown in FIG. 4 is defined as Example 1, an example in which the communication path 51 forming the bypass passage 50 opens at the bolt hole β adjacent to the bolt hole α in the lowest part (position of 45°±10°) as shown in FIG. 5 is defined as Example 2, and an example in which the communication path 51 forming the bypass passage 50 opens at the bolt hole γ which is two holes adjacent to the bolt hole α in the lowest part (position of 90°±10°) as shown in FIG. 6 is defined as Example 3.

(Endurance Test)

First, at the time of low-speed rotation, excessive temperature rise in the crank chamber due to excessive accumulation of oil matters little since the function of centrifugal separation by the shaft is low, the amount of oil held in the crank chamber is relatively small, and the degree in which the oil is stirred and generates heat is low.

Accordingly, the endurance tests were performed at the time of high-speed operation in a case where a heat load of a refrigeration cycle is high (high-speed high-load) and in a case where the heat load is low (high-speed low-load), the amount of remaining oil in the crank chamber, the oil circulation ratio (OCR) in the refrigeration cycle and the temperature in the crank chamber (crank temperature) during the endurance tests were compared with those of the related-art example not provided with the bypass passage. The results are shown in FIG. 7(*a*) to (*c*).

Here, in the high-speed high-load operation, as the discharge capacity of the variable displacement compressor is increased, the amount of work by the compressor becomes large and the temperature in the crank chamber becomes higher. However, oil easily returns to the compressor from the refrigeration cycle with a large amount of refrigerant which circulates in the refrigeration cycle, therefore, the lubrication of sliding components in the compressor can be secured by the oil circulating in the refrigeration cycle even when little oil is held in the compressor.

On the other hand, in the high-speed low-load operation, as the discharge capacity of the variable displacement compressor is reduced, the amount of work by the compressor also becomes small and the temperature in the crank chamber becomes lower. However, the refrigerant circulating in the refrigeration cycle is reduced, therefore, oil tends to be stay in the refrigeration cycle and it is difficult to expect the lubrication in the compressor by the oil mixed in the refrigerant circulating in the refrigeration cycle.

(Liquid Start-Up Test)

Liquid staying in the crank chamber is not limited to oil but a refrigerant may be liquefied and pooled. That is, when the compressor is not operated and stopped for a long period of time, it is known that the pressure in the refrigeration cycle is balanced and the refrigerant is liquefied in the compressor which is a region with the lowest temperature (region with the largest heat capacity) in the refrigeration cycle, which causes accumulation of the liquid refrigerant in the crank chamber.

In the case where the compressor is started from the state where the pressure is balanced, the pressure in the suction chamber is reduced by the operation of the compressor and the refrigerant in the control pressure chamber is discharged to the suction chamber through the release passage. However, when the liquid refrigerant is pooled in the control pressure chamber, the inside of the control pressure chamber is in the balanced state in which both a gas-phase refrigerant and a liquid-phase refrigerant exist, therefore, the pressure in the control pressure chamber is maintained in a saturation pressure even when the refrigerant in the control pressure chamber is discharged to the suction chamber through the release passage. Accordingly, the pressure in the control pressure chamber is not reduced until all the liquid refrigerant is gasified and discharged from the release passage, which causes an inconvenience that it is difficult to perform control of the discharge capacity (the discharge capacity does not increase).

Accordingly, it is required to quickly discharge the liquid refrigerant in the crank chamber to the suction chamber to shorten the time until the compressor is started. Because of this, variation in the start-up time of the compressor caused by providing the bypass passage is also desired to be evaluated.

The results obtained by measuring the start-up time of the compressor concerning the related-art and Examples 1 to 3 are shown in FIG. 7(*d*).

As a result of performing the above endurance tests and the liquid start-up tests, the following knowledge concerning respective examples was obtained.

Example 1

As the bypass passage 50 opens at the lowest bolt hole α in Example 1, the amount of remaining oil in the crank chamber obtained after the end of compression was almost zero both in the high-speed high-load endurance test and the high-speed low-load endurance test. The heat generation does not occur due to the stirring of the lubrication oil as there is little amount of remaining oil, therefore, the crank temperature is sufficiently low as compared with the related art. In particular, OCR is extremely high (5.7%) in the condition of high-speed and high-load, and the lubrication inside the compressor is secured by the oil circulating in the refrigeration cycle, therefore, it seems that the rise of temperature in the crank is prevented.

On the other hand, there is little oil circulating in the refrigeration cycle (OCR: 0.5%) in the high-speed low-load, and the crank temperature is slightly higher than those of Examples 2 and 3. In view of the above, it seems that the lubricating oil was slightly insufficient, but the crank temperature was sufficiently low as compared with the related art and the supply of the lubricating oil to the swash plate was sufficiently secured.

In the liquid start-up tests, it took 67 seconds until start-up in the related art, whereas it took 30 seconds in Example 1. That seems because the refrigerant stored in the lower part of the crank chamber 2 could be discharged as the bypass passage 50 opens at the lowest bolt hole α.

Example 2

As the bypass passage 50 opens at the bolt hole β adjacent to the bolt hole α in the lowest part in Example 2, a proper amount of oil in a degree not being stirred remained after the end of the compressor both in the high-speed high-load endurance test and the high-speed and low-load endurance test. The crank temperature was the lowest in Examples 1, 2 and 3 and it seemed that the most preferable amount of oil were secured in the crank chamber 2.

On the other hand, in the liquid start-up test, the start-up time was 35 seconds, which was slightly delayed as compared with Example 1. This seems because a liquid refrigerant stored in the lowest part in the liquid refrigerant stored in the crank chamber was not capable of being discharged quickly since the opening position of the bypass passage was not the bolt hole in the lowest part. Nevertheless, the start-up time has been shortened to approximately half of the related-art start-up time, therefore, it is highly effective to provide the bypass passage.

Example 3

In Example 3, approximately the same results as Example 2 were obtained concerning the amount of remaining oil in the crank chamber and the crank temperature in the endurance test. On the other hand, in the liquid start-up test, the start-up time was 53 seconds, which was further delayed as compared with Example 2. This seems because the refrigerant stored in the crank chamber was increased as compared with the case of Example 2. However, accumulation of excessive oil in the crank chamber was prevented (the amount of remaining oil is largely reduced as compared with the related art) in the high-speed endurance test in the same manner as Example 2, and the temperature rise in the crank is also suppressed.

Consequently, the accumulation of excessive oil in the crank chamber was prevented and the temperature rise in the crank was suppressed both in the high-speed and high-load operation state and in the high-speed low-load operation state while securing the oil supply to the swash plate 18 in all Examples 1 to 3, that is, better results were obtained as compared with the related art not provided with the bypass passage.

Accordingly, the region of the bypass passage communicating with the crank chamber is preferably positioned at least in approximately the same height as the shaft 7 (a position of 90°±10° when taking the position under the center of the housing hole 12 supporting the shaft 7 as a reference (as 0 (zero) degree)) or in a lower position than that as well as in the outer side of the rotation trajectory of the swash plate in the radial direction, in addition, taking the start-up time into consideration, more preferably, in the position of 45°±10° or in a lower position than that.

Figure 8:
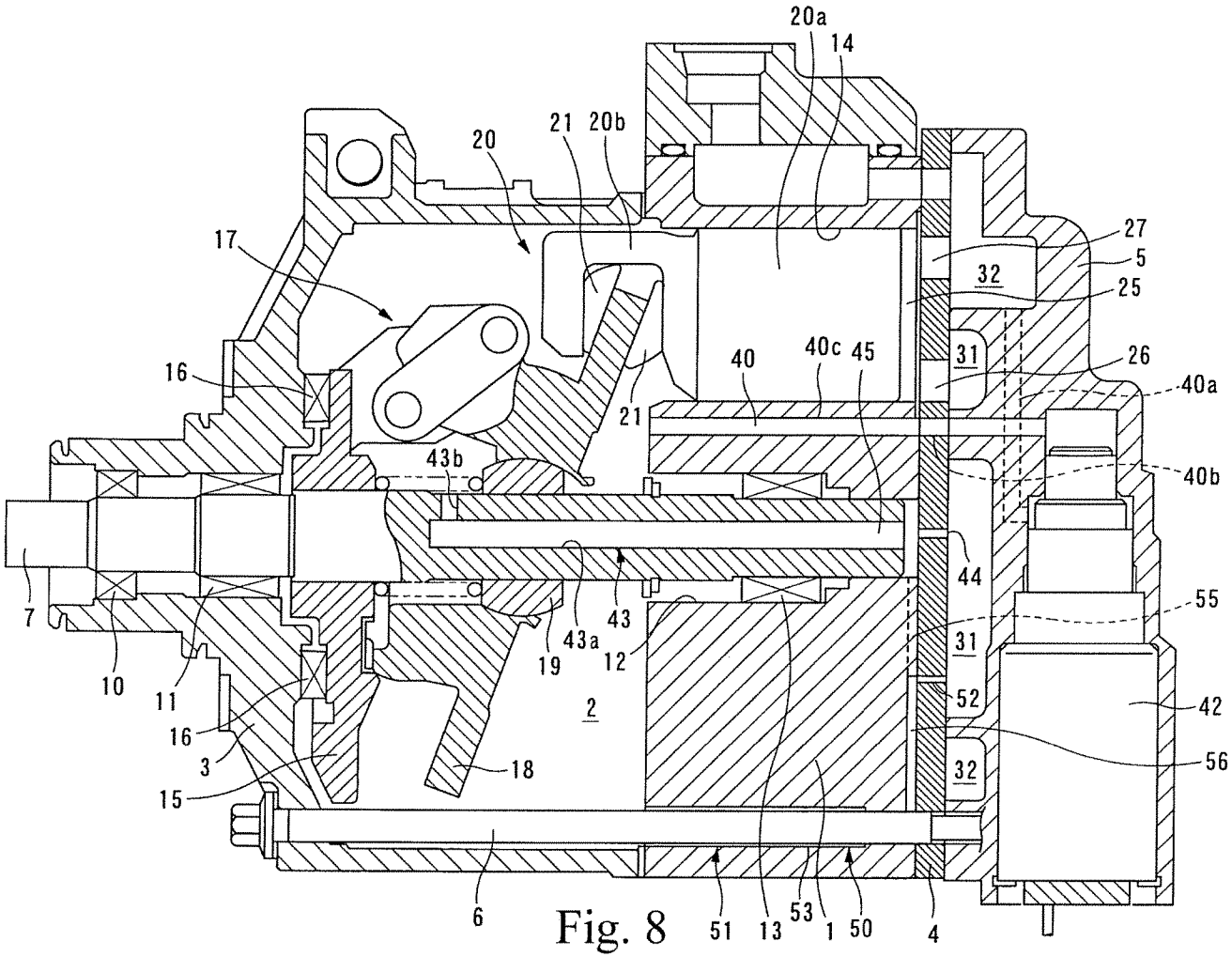
FIG. 8 is a cross-sectional view of a compressor showing another configuration example of the bypass passage according to the present invention.

In the above examples, a configuration in which the communication path 51 communicating with the orifice 52 includes the first passage forming portion 51*a* and the second passage forming portion 51*b* is illustrated, however, it may be configured such that a groove 56 allowing the bolt hole 53 to communicate with the orifice hole 52 is formed in an end surface where the cylinder block 1 contacts with the valve plate 4 as shown in FIG. 8 and that the communication path 51 is formed by including the bolt hole 53 and the groove 56 formed in the end surface of the cylinder block 1.

Also in such a configuration, it is not necessary to change design of the position of the bolt hole and so on for forming the entrance of the bypass passage 50. In addition, as the entrance of the bypass passage is configured by the opening end of the bolt hole 53 into which the fastening bolt 6 is inserted (the gap between the bolt and the inner peripheral surface of the bolt hole), turbulence of the working fluid stirred in the crank chamber is suppressed and the oil can be released to the suction chamber stably. Moreover, the bypass passage 50 (communication path 51) can be formed only by forming the groove in the end surface of the cylinder block while using the entire bolt hole, therefore, it is not necessary to drill the hole in the cylinder block 1 and it is possible to form the bypass passage extremely easily.

Although the example in which the orifice hole 44 of the release passage 45 and the orifice hole 52 of the bypass passage 50 are separately formed is illustrated in the above, it can be done by using one orifice hole in common.

For example, it is also possible to eliminate the orifice hole 52 in the structure of FIG. 1 and FIG. 8 and form a communication groove 55 which allows the communication path 51 to communicate with the housing hole 12 in an end surface of the cylinder block 1 opposed to the valve plate 4 to thereby use the orifice hole 44 of the release passage 45 as the orifice hole of the bypass passage 50.

REFERENCE SIGNS LIST

1 cylinder block
2 crank chamber
3 front housing
4 valve plate
5 rear housing
6 fastening bolt
7 shaft
14 cylinder bore
18 swash plate
20 piston
25 compression chamber
31 suction chamber
32 discharge chamber
40 supply passage
43 oil separation passage
43*a* shaft hole
43*b* side hole
44 orifice hole
50 bypass passage
51 communication path
51*a* first passage forming portion
52*b* second passage forming portion
52 orifice hole
53 bolt hole

The invention claimed is:

1. A variable displacement swash plate compressor comprising:

a cylinder block in which a plurality of cylinder bores are formed;

a front housing assembled to a front side of the cylinder block to define a crank chamber;

a rear housing attached to a rear side of the cylinder block, in which a suction chamber and a discharge chamber are formed;

pistons arranged in respective cylinder bores of the cylinder block so as to reciprocate;

a shaft supported by the front housing and the cylinder block so as to rotate freely;

a swash plate rotating integrally with the shaft and attached to the shaft so that a tilt angle is variable; and shoes interposed between a peripheral edge portion of the swash plate and the pistons so as to slide, converting a rotating motion of the swash plate into a reciprocating motion of the pistons, wherein a supply passage allowing the discharge chamber to communicate with the crank chamber and a release passage allowing the crank chamber to communicate with the suction chamber are provided for controlling a pressure in the crank chamber to control the tilt angle of the swash plate with respect to the shaft, wherein part of the release passage is formed by an oil separation passage formed in the shaft, wherein the oil separation passage is configured by including a shaft hole extended in an axial direction from a rear end to a front end of the shaft, and a side hole extended in a radial direction and communicating with the shaft hole as well as opening to the crank chamber, wherein the supply passage is configured by including a through hole formed in the cylinder block so that the through hole opens at a region opposed to the swash plate, wherein a bypass passage allowing the crank chamber to constantly communicate with the suction chamber is provided separately from the release passage, wherein a region of the bypass passage communicating with the crank chamber is positioned in an outer side of a rotation trajectory of the swash plate in the radial direction, and wherein the bypass passage communicates with the crank chamber by using part or whole of a bolt hole formed in the cylinder block for inserting a bolt which fastens the cylinder block to the housing in the axial direction.

2. The variable displacement swash plate compressor according to claim 1, wherein a valve plate is provided between the cylinder block and the rear housing, and the release passage and the bypass passage respectively include orifice holes formed in the valve plate at regions communicating with the suction chamber.

3. The variable displacement swash plate compressor according to claim 1, wherein the bypass passage is configured by including the bolt hole and a communication path opening at an inner peripheral surface of the bolt hole.

4. The variable displacement swash plate compressor according to claim 1, wherein the bypass passage includes a first passage forming portion drilled obliquely upward from a lower part of the cylinder block on a side of the crank chamber between the cylinder bores, and a second passage forming portion drilled in approximately parallel to the shaft from an end surface of the cylinder block on an opposite side of the end surface opposed to the crank chamber and communicating with the first passage forming portion.

5. The variable displacement swash plate compressor according to claim 1, wherein the bypass passage communicates with a lower part of the crank chamber.

6. The variable displacement swash plate compressor according to claim 1, wherein an opening end of the bypass passage with respect to a center of an accommodation hole of the cylinder block is formed in a range of 0°±10° when a direction under the center of the hole which supports the shaft is prescribed as 0 (zero) degree.

7. The variable displacement swash plate compressor according to claim 1, wherein an opening end of the bypass passage with respect to a center of an accommodation hole of the cylinder block is formed in a range of 45°±10° when a direction position under the center of the hole which supports the shaft is prescribed as 0 (zero) degree.

8. The variable displacement swash plate compressor according to claim 2, wherein the bypass passage is configured by including the bolt hole and a communication path opening at an inner peripheral surface of the bolt hole.

9. The variable displacement swash plate compressor according to claim 2, wherein the bypass passage includes a first passage forming portion drilled obliquely upward from a lower part of the cylinder block on the crank chamber side between the cylinder bores, and a second passage forming portion drilled in approximately parallel to the shaft from an end surface of the cylinder block on an opposite side of the end surface opposed to the crank chamber and communicating with the first passage forming portion.

10. The variable displacement swash plate compressor according to claim 2, wherein the bypass passage communicates with a lower part of the crank chamber.

11. The variable displacement swash plate compressor according to claim 2, wherein an opening end of the bypass passage with respect to a center of an accommodation hole of the cylinder block is formed in a range of 0°±10° when a direction under the center of the hole which supports the shaft is prescribed as 0 (zero) degree.

12. The variable displacement swash plate compressor according to claim 2, wherein an opening end of the bypass passage with respect to a center of an accommodation hole of the cylinder block is formed in a range of 45°±10° when a direction under the center of the hole which supports the shaft is prescribed as 0 (zero) degree.

13. The variable displacement swash plate compressor according to claim 3, wherein an opening end of the bypass passage with respect to a center of an accommodation hole of the cylinder block is formed in a range of 0°±10° when a direction under the center of the hole which supports the shaft is prescribed as 0 (zero) degree.

14. The variable displacement swash plate compressor according to claim 3, wherein an opening end of the bypass passage with respect to a center of an accommodation hole of the cylinder block is formed in a range of 45°±10° when a direction under the center of the hole which supports the shaft is prescribed as 0 (zero) degree.

15. A variable displacement swash plate compressor comprising:

a cylinder block in which a plurality of cylinder bores are formed;

a front housing assembled to a front side of the cylinder block to define a crank chamber;

a rear housing attached to a rear side of the cylinder block, in which a suction chamber and a discharge chamber are formed;

pistons arranged in respective cylinder bores of the cylinder block so as to reciprocate;

a shaft supported by the front housing and the cylinder block so as to rotate freely;

a swash plate rotating integrally with the shaft and attached to the shaft so that a tilt angle is variable; and shoes interposed between a peripheral edge portion of the swash plate and the pistons so as to slide, converting a rotating motion of the swash plate into a reciprocating motion of the pistons, wherein a supply passage allowing the discharge chamber to communicate with the crank chamber and a release passage allowing the crank chamber to communicate with the suction chamber are provided for controlling a pressure in the crank chamber to control the tilt angle of the swash plate with respect to the shaft, wherein part of the release passage is formed by an oil separation passage formed in the shaft, wherein the oil separation passage is configured by including a shaft hole extended in an axial direction from a rear end to a front end of the shaft, and a side hole extended in a radial direction and communicating with the shaft hole as well as opening to the crank chamber, wherein the supply passage is configured by including a through hole formed in the cylinder block so that the through hole opens at a region opposed to the swash plate, wherein a bypass passage allowing the crank chamber to constantly communicate with the suction chamber is provided separately from the release passage, wherein a valve plate is provided between the cylinder block and the rear housing, and the release passage and the bypass passage respectively include orifice holes formed in the valve plate at regions communicating with the suction chamber, and wherein the bypass passage communicates with the crank chamber by using part or whole of a bolt hole formed in the cylinder block for inserting a bolt which fastens the cylinder block to the housing in the axial direction.

16. A variable displacement swash plate compressor comprising:

a cylinder block in which a plurality of cylinder bores are formed;

a front housing assembled to a front side of the cylinder block to define a crank chamber;

a rear housing attached to a rear side of the cylinder block, in which a suction chamber and a discharge chamber are formed;

pistons arranged in respective cylinder bores of the cylinder block so as to reciprocate;

a shaft supported by the front housing and the cylinder block so as to rotate freely;

a swash plate rotating integrally with the shaft and attached to the shaft so that a tilt angle is variable; and shoes interposed between a peripheral edge portion of the swash plate and the pistons so as to slide, converting a rotating motion of the swash plate into a reciprocating motion of the pistons, wherein a supply passage allowing the discharge chamber to communicate with the crank chamber and a release passage allowing the crank chamber to communicate with the suction chamber are provided for controlling a pressure in the crank chamber to control the tilt angle of the swash plate with respect to the shaft, wherein part of the release passage is formed by an oil separation passage formed in the shaft, wherein the oil separation passage is configured by including a shaft hole extended in an axial direction from a rear end to a front end of the shaft, and a side hole extended in a radial direction and communicating with the shaft hole as well as opening to the crank chamber, wherein the supply passage is configured by including a through hole formed in the cylinder block so that the through hole opens at a region opposed to the swash plate, wherein a bypass passage allowing the crank chamber to constantly communicate with the suction chamber is provided separately from the release passage, wherein a region of the bypass passage communicating with the crank chamber is positioned in an outer side of a rotation trajectory of the swash plate in the radial direction, wherein the bypass passage communicates with the crank chamber by using part or whole of a bolt hole formed in the cylinder block for inserting a bolt which fastens the cylinder block to the housing in the axial direction, and wherein the bypass passage is configured by including the bolt hole and a communication path opening at an inner peripheral surface of the bolt hole.

* * * * *